US010202269B2

(12) United States Patent
Forte et al.

(10) Patent No.: US 10,202,269 B2
(45) Date of Patent: Feb. 12, 2019

(54) BEVERAGE DISPENSER AND METHOD FOR SANITATION THEREOF

(71) Applicant: NEVIOT—NATURE OF GALILEE LTD., Lod (IL)

(72) Inventors: Yehuda Forte, Yavne (IL); Maayan Bronstein, Hadera (IL)

(73) Assignee: NEVIOT—NATURE OF GALILEE LTD., Lod (IL)

( * ) Notice: Subject to any disclaimer, the term of this patent is extended or adjusted under 35 U.S.C. 154(b) by 180 days.

(21) Appl. No.: 14/849,634

(22) Filed: Sep. 10, 2015

(65) Prior Publication Data

US 2016/0023880 A1 Jan. 28, 2016

Related U.S. Application Data

(63) Continuation-in-part of application No. 14/368,303, filed as application No. PCT/IL2012/050551 on Dec. 25, 2012, now Pat. No. 9,243,387.

(30) Foreign Application Priority Data

Dec. 26, 2011 (IL) ..... 217213

(51) Int. Cl.

| | |
|---|---|
| ***B67D 1/00*** | (2006.01) |
| ***B67D 1/07*** | (2006.01) |
| ***B67D 1/08*** | (2006.01) |
| ***B67D 1/10*** | (2006.01) |

(52) U.S. Cl.

CPC ..... *B67D 1/07* (2013.01); *B67D 1/0009* (2013.01); *B67D 1/0859* (2013.01); *B67D 1/0895* (2013.01); *B67D 1/10* (2013.01); *B67D 2001/075* (2013.01); *B67D 2001/0827* (2013.01)

(58) Field of Classification Search

CPC ..... B67D 1/0004; B67D 1/07; B67D 1/0857; B67D 1/0888; B67D 1/0895; B67D 1/10; B67D 2210/00013; B67D 1/0859; B67D 1/0009; B08B 9/08

USPC ..... 222/146.1, 67, 146.6, 105, 185.1

See application file for complete search history.

(56) References Cited

U.S. PATENT DOCUMENTS

| | | | | |
|---|---|---|---|---|
| 6,143,258 A * | 11/2000 | Tamura | A61L 2/24 | 210/175 |
| 6,207,046 B1 * | 3/2001 | Yamashita | B67D 1/07 | 210/138 |
| 6,926,170 B2 * | 8/2005 | Groesbeck | B67D 1/0021 | 222/105 |
| 7,905,374 B2 * | 3/2011 | Yui | A61L 2/04 | 222/146.1 |

(Continued)

*Primary Examiner* — Charles P Cheyney

(74) *Attorney, Agent, or Firm* — Soroker Agmon Nordman

(57) ABSTRACT

A method for sanitizing a beverage dispenser apparatus includes filling fluid in at least a hot beverage tank of a beverage dispensing apparatus, heating the fluid in the hot beverage tank to a predetermined temperature range, configuring the drain valve to a closed state, activating a primary sanitation cycle by causing the heated fluid from the hot beverage tank to flow through at least a first subset of components of the beverage dispenser apparatus and terminating the primary sanitation cycle when at least one predetermined condition is satisfied. A secondary sanitation cycle is activated by causing the heated fluid from the hot beverage tank to flow through at least a second subset of components of the beverage dispenser apparatus.

7 Claims, 7 Drawing Sheets

(56) References Cited

U.S. PATENT DOCUMENTS

| | | | | |
|---|---|---|---|---|
| 9,480,762 | B2 * | 11/2016 | Wang | A61L 2/18 |
| 2008/0226521 | A1 * | 9/2008 | Nakano | A47J 31/60<br>422/307 |

* cited by examiner

BEVERAGE DISPENSER AND METHOD FOR SANITATION THEREOF

FIELD OF THE INVENTION

The subject matter relates generally to beverage dispensers and a method for sanitizing the dispenser, e.g. filtered water dispensers, mineral water dispensers or beverage dispensers having a sanitation mechanism.

BACKGROUND OF THE INVENTION

Beverage dispensers are used in both businesses and for residential use to provide available beverage to users. The demands to ensure safety of drinking beverage and to pursue the quality in natural character of drinking beverage have been increased according to the increase of users' interest with respect to drinking beverage.

Beverage dispensers may provide users with filtered beverage. Such filtered beverage is received at the beverage dispenser from a central beverage system and filtered via a filtering module within the beverage dispenser. Other beverage dispensers provide users with beverage. Such beverage is packaged in periodically replaced containers. The containers have an outlet connected to a faucet from which the beverage is dispensed.

Beverage dispensers having beverage containers or filtered beverage suffer from contamination of the tubes, valves, tanks, or other components of the beverage dispenser. The tube provides beverage from the central beverage system or from the beverage container to the faucet from which the beverage is provided to the consumer. Such contamination significantly reduces beverage quality of the beverage dispenser. It is desired to provide a system and method for treating such contamination in beverage dispensers.

SUMMARY

The subject matter discloses a beverage dispenser apparatus with a self-sanitation mechanism, comprising a plurality of components, said components include at least one beverage tank, e.g. a cold beverage tank and/or a hot beverage tank, and a beverage outlet for dispensing beverage from the beverage dispenser apparatus, said beverage outlet is connected to the at least one beverage tank, e.g. to a hot beverage tank and/or to the cold beverage tank. The beverage dispenser apparatus further comprises a suction unit which may be configured to receive fluid from the at least one beverage tank, the suction unit may be configured to generate a sanitation cycle and to transfer fluid through said at least subset of components of the beverage dispenser apparatus. The sanitation cycle may include e.g., cleaning, purification, sanitation, sterilization, filtration, disinfection, or pasteurization of at least a subset of components of the beverage dispenser apparatus.

The sanitation mechanism may be configured to clean components of the beverage dispenser apparatus such as tubes, valves and tanks of the beverage dispenser apparatus. The sanitation mechanism causes a fluid, e.g. or a sanitation solution, to flow through tubes within the beverage dispenser apparatus. In some embodiments, the beverage dispenser apparatus may include a beverage inlet for receiving beverage from a beverage supplying system. The beverage dispenser apparatus may include a first valve for controlling beverage flow from the suction unit to a first beverage tank, e.g. a hot water tank. For example, the first valve may be the second valve for controlling beverage flow from the suction unit to a second beverage tank e.g. a cold water tank. The beverage dispenser apparatus may further include the cold beverage tank and a second valve for controlling beverage flow from the suction unit to the cold beverage tank. For example, the second valve may be the cold unit valve for controlling beverage flow to a second cold suction tube.

The suction unit may be configured to transfer beverage to the hot beverage tank and to the cold beverage tank. The beverage dispenser apparatus may include a first cold suction tube connected to the cold beverage tank and to the suction unit and a suction valve allowing beverage to flow from the first cold suction tube to the hot beverage tank.

According to some embodiments, the beverage dispenser apparatus may include an outlet valve for controlling beverage dispensing from the beverage outlet. Hot fluid may flow from the hot beverage tank to at least subset of components of the beverage dispenser apparatus, e.g. to the cold beverage tank, and/or to tubes and/or to valves of the beverage dispenser apparatus, when the hot unit valve allows beverage to flow from the suction unit to the hot beverage tank. The beverage dispenser apparatus may include a second valve for controlling fluid flow to the second cold suction tube.

The sanitation cycle of at least a subset of components of the beverage dispenser apparatus may comprise, for example, sanitation of a hot outlet tube and a cold outlet tube. In some embodiments, the sanitation of the hot outlet tube and the cold outlet tube is performed when the cold unit valve may be in a closed state, the hot unit valve may be in an open state and the suction valve may be in an open state. In some embodiments, the sanitation may be performed when the cold unit valve may be in an open state, the hot unit valve may be in a closed state and the suction valve may be in an open state. The beverage dispenser apparatus may include a heating unit connected to at least one beverage tank, for example connected to the cold beverage tank and/or to the hot beverage tank.

In some embodiments, a user of the beverage dispenser apparatus activates the sanitation mechanism. In some embodiments, a control unit activates the sanitation mechanism automatically.

The subject matter further discloses a method for sanitizing or cleaning a beverage dispenser apparatus. The method may include filling fluid in at least one beverage tank of a beverage dispensing apparatus, and heating the fluid in the beverage tank, for example until it reaches a predetermined temperature range. The method may include activating a sanitation cycle, by causing, for example, heated fluid or a cleaning fluid from the beverage tank to flow through at least a subset of components of the beverage dispenser apparatus. The components may include valves, tubes, one or more tanks, a suction unit, a beverage outlet for dispensing fluid from the beverage dispenser apparatus, or any other unit or combination of units of the beverage dispensing apparatus. A subset of components may include, for example, certain tubes and valves, or a subset of tubes and valves of the beverage dispenser apparatus.

The sanitation cycle may be stopped, for example automatically stopped or terminated, according to a predetermined condition, e.g. after a predetermined time duration is reached. The sanitation cycle may include causing fluid to flow from the hot beverage tank to a cold beverage tank. The method may include maintaining the heated fluid at least at a certain preset temperature, or within a predetermined temperature range.

A user may be notified of a cleaning or sanitation event, e.g. by displaying an alert on a display screen. A sanitation event notification may include, for example, that a sanitation cycle is required, or that a sanitation cycle is being performed, or that a sanitation cycle has been completed.

In some embodiments of the present application the subject matter discloses a hot/cold beverage dispenser comprising: a beverage dispensing system which may be configured to selectively supply beverage contained in said beverage container to a hot beverage tank and to a cold beverage tank and further configured to selectively provide hot beverage from said hot beverage tank and cold beverage from said cold beverage tank to a user of said hot/cold beverage dispenser, and a beverage pump fluidly coupling a beverage flow system and said beverage dispensing system and being operable to pump a quantity of hot fluid from said hot beverage tank to an empty beverage container via said beverage flow system, wherein subsequent to emptying a predetermined number of said beverage containers, said beverage pump is activated for a first predetermined time period to pump said quantity of hot fluid to said empty beverage container via said beverage flow system thereby said quantity of hot fluid cleanses said beverage flow system and said empty beverage container.

The subject matter also discloses a method for cleansing a hot/cold beverage dispenser comprising: providing said hot/cold beverage dispenser, comprising: a housing enclosing a beverage container, and a beverage dispensing system may be configured to selectively supply beverage contained in said beverage container to a hot beverage tank and a cold beverage tank and may be further configured to selectively provide hot beverage from said hot beverage tank, and cold beverage from said cold beverage tank to a user of said hot/cold beverage dispenser, configuring a beverage pump to pump a quantity of hot fluid for a first predetermined time period from said hot beverage tank to an empty beverage container via a beverage flow system, and cleansing said beverage container and said fluid flow system for a second predetermined time period with said quantity of hot fluid.

BRIEF DESCRIPTION OF THE DRAWINGS

Exemplary non-limited embodiments of the disclosed subject matter will be described, with reference to the following description of the embodiments, in conjunction with the figures. The figures are generally not shown to scale and any sizes are only meant to be exemplary and not necessarily limiting. Corresponding or like elements are optionally designated by the same numerals or letters.

In some embodiments the beverage may include e.g. various types of fluids such as juice, water combined with e.g. juice concentrate, a taste capsule or soda water.

DETAILED DESCRIPTION

The disclosed subject matter provides for a beverage dispensing apparatus for residential or business use. The subject matter provides a method and system for sanitation the beverage dispensing apparatus. Such sanitation may be enabled by adding a tube connected to one of the cold beverage tank or the hot beverage tank of the beverage dispensing apparatus and using a suction unit. The suction unit sucks beverage from one of the beverage tanks disclosed above and via a plurality of valves. The valves control beverage flow at tubes within the beverage dispensing apparatus, such that when sanitizing, fluid flows in a closed system manner at the beverage tanks and tubes and does not exit the beverage dispensing apparatus.

Figure 1:
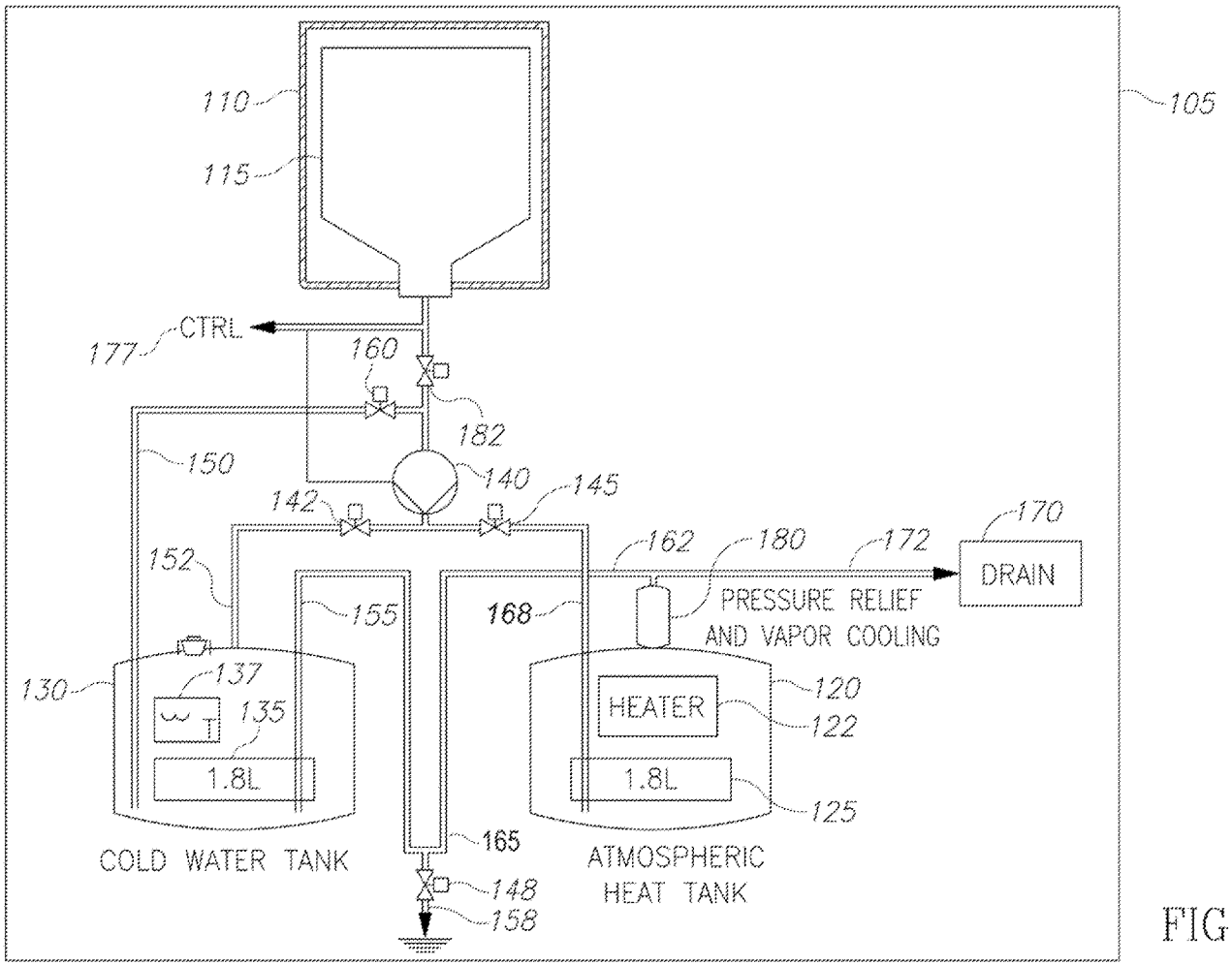
FIG. 1 shows a beverage dispensing apparatus having a sanitation system, according to some exemplary embodiments of the subject matter.

FIG. 1 shows a beverage dispensing apparatus having a sanitation system, according to some exemplary embodiments of the subject matter. The beverage dispensing apparatus 105 may be disposed in a housing 110. The housing 110 covers other parts of the beverage dispensing apparatus, such as tubes, cold beverage unit, hot beverage unit and the like. The beverage dispensing apparatus 105 comprises an outlet 158 from which beverage may be dispensed from the beverage dispensing apparatus 105.

The beverage dispensing apparatus 105 comprises a beverage supplying unit 115. The beverage supplying unit 115 may be a beverage container or any beverage supply. The beverage supplying unit 115 may be a bag in a box (BIB) unit, in which the beverage are contained in a bag, such as a plastic bag, and the bag may be disposed in a rigid or semi rigid box, for protection. The beverage supplying unit 115 may be connected to a central beverage system from which beverage may be provided to the beverage dispensing apparatus 105. In such case, beverage may be filtered or purified at the beverage dispensing apparatus 105. The beverage supplying unit 115 may be connected to a supply valve 182. The supply valve 182 may control beverage supply from the beverage supplying unit 115 to the rest of the beverage dispensing apparatus 105, towards the outlet 158.

The beverage dispensing apparatus 105 further comprises a hot beverage unit 120. The hot beverage unit 120 comprises a heating unit 122 for heating beverage contained in a hot beverage tank 125. The hot beverage tank 125 may be connected to the outlet 158 via a hot outlet tube 165 and the outlet valve 148.

The beverage dispensing apparatus 105 further comprises a cold beverage unit 130. The cold beverage unit 130 comprises a temperature sensor 132 for detecting temperature of beverage contained in a cold beverage tank 135. The cold beverage tank 135 may be connected to the outlet 158 via a cold outlet tube 155 and the outlet valve 148. The beverage dispensing apparatus 105 further comprises a suction unit 140 which enables activating a reverse suction mode. For example, suction unit 140 may be or may include a reversible pump which may be configured, e.g. by a control unit 177, to pump water either in a first (e.g. forward) direction or in a second (e.g. reverse) direction. When sanitizing tubes and tanks at the beverage dispensing apparatus, the suction unit 140 may be connected to at least one of the cold beverage unit 130 or the hot beverage unit 120 and sucks fluid from at least one of them. In some embodiments, the heating unit 122, or another heating unit, may be connected to the hot beverage tank 125, in order to heat the fluid during a sanitation process or cycle of the hot beverage tank 125.

The suction unit 140 may be connected to a power supply (not shown). The suction unit may be connected to the control unit 177, from which the suction unit 140 receives a command to perform suction, e.g. in a first or a second direction. The control unit 177 may also determine the unit from which the suction unit 140 sucks fluid, for example the hot beverage unit 120 or the cold beverage unit 130.

In some exemplary cases, the beverage dispensing apparatus 105 further comprises a first cold suction tube 150 connecting the cold beverage unit 130 to the suction unit 140. When sanitizing the tubes of the beverage dispensing apparatus 105, the suction unit 140 may suck fluid from the cold beverage tank 135 via the first cold suction tube 150. The suction unit may be located near the cold unit valve 142 and a hot unit valve 145. When sucking fluid from the cold beverage tank 135, the amount of fluid at the cold beverage tank 135 reduces while fluid may be transferred at the first cold suction tube 150. In some exemplary cases, the cold beverage tank 135 contains fluid in the range of 1.5-2 liters. A cooling unit 137 regulates the fluid temperature at the cold beverage tank 135. When sanitizing the tubes and tanks of the beverage dispensing apparatus, the flow rate of fluid sucked from the cold beverage tank 135 by the suction unit 140 may be, for example, in the range of 0.001-3 liters per minute.

In some exemplary cases, the suction unit 140 may be configured to pump beverage from the beverage supplying unit 115 to the cold beverage tank 135 and to the hot beverage tank 125. This way, beverage from the beverage supplying unit 115 cannot flow using gravitation. The suction unit 140 may be connected to the outlet of a suction tube, such as the first cold suction tube 150. In some exemplary cases, the suction tube may also be connected to the hot beverage tank 125. The suction tube may be connected on a first end to the suction unit 140 and on a second end to a beverage tank selected from the cold beverage tank 135 and the hot beverage tank 125.

Hence, the suction unit 140 may pump fluid from the first cold suction tube 150 when performing the sanitation process of the subject matter. It is shown that a single pump, the suction unit 140, both initiates the sanitation process and delivers fluid from the beverage supplying unit 115 to the cold beverage tank 135 and to the hot beverage tank 125. A single pump embodiment may be achieved by positioning the first cold suction tube 150 outlet in the vicinity of the suction unit 140. A single pump that performs both the sanitation process and the fluid delivery may be especially necessary for compact dispensing devices, for residential use. Such compact devices may be of a height of less than 60 centimeters and may be configured to be located on a kitchen top.

Figure 2:
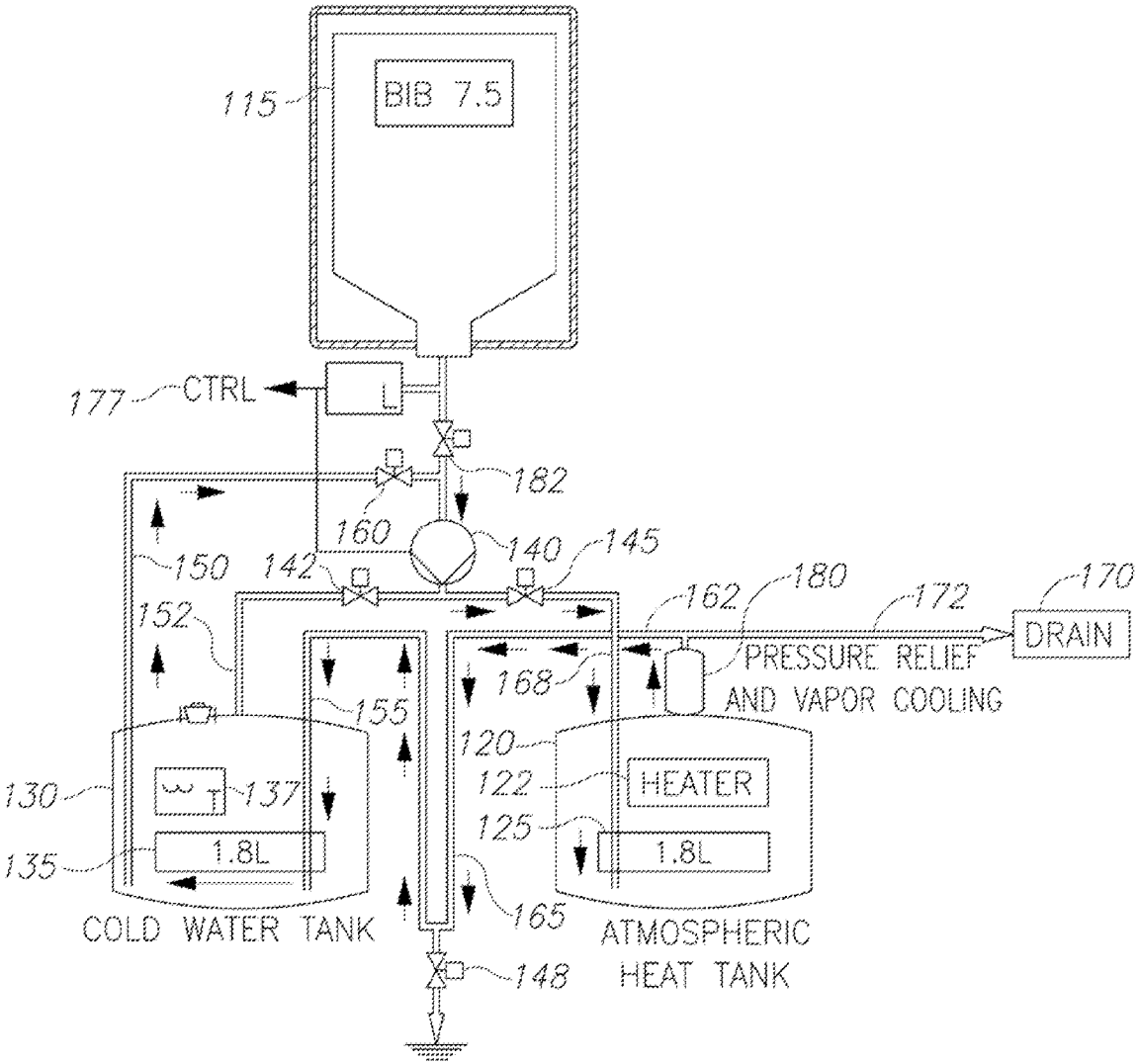
FIG. 2 shows a flow of fluid at a beverage dispensing apparatus during a sanitation cycle, according to exemplary embodiments of the disclose subject matter.
Figure 3:
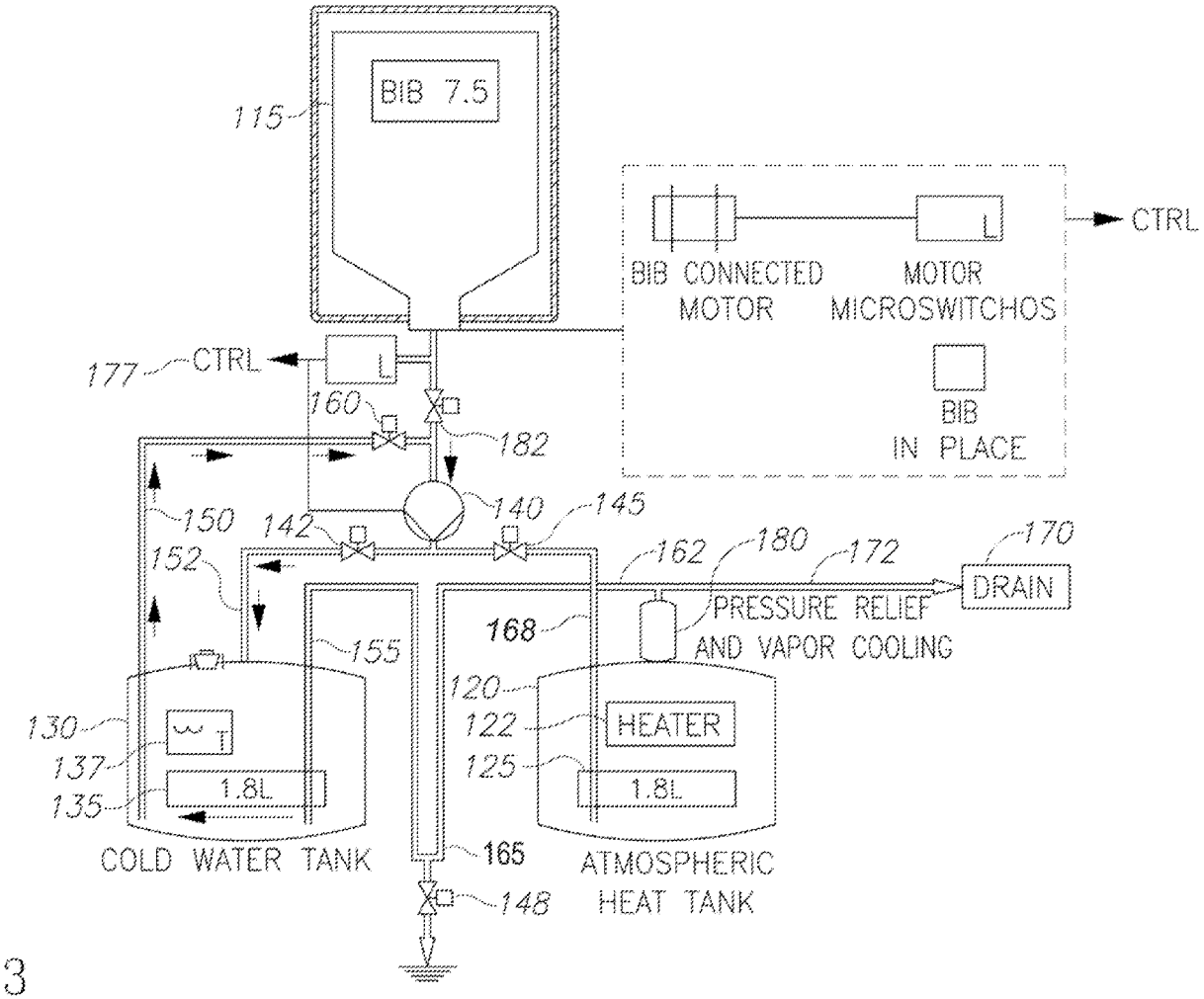
FIG. 3 shows a flow of fluid at the second cold suction tube of a beverage dispensing apparatus during a sanitation cycle, according to exemplary embodiments of the disclosed subject matter.

FIG. 2 shows a flow of fluid at a beverage dispensing apparatus during a sanitation cycle, according to exemplary embodiments of the disclose subject matter. In the example shown below, fluid may be first sucked from the cold beverage tank 135. In an alternative embodiment, fluid may be sucked from the hot beverage tank 125 by connecting the first cold suction tube 150 to the hot beverage unit 120. In an exemplary embodiment of the disclosed subject matter, sanitizing the beverage dispenser apparatus comprises two cycles. In a first (e.g. a primary) cycle, fluid flows through the hot outlet tube 165 and through the cold outlet tube 155. In a second (e.g. secondary) cycle, fluid flows through a second cold suction tube 152, as shown in FIG. 3. The second cold suction tube 152 connects the cold beverage tank 135 to the suction unit 140.

When sanitizing the hot outlet tube 165 and the cold outlet tube 155 of the beverage dispensing apparatus 105, the cold unit valve 142 may be in a closed state and the hot unit valve 145 may be in an open state, the outlet valve 148 may be in a closed state and the supply valve 182 may be in a closed state. The suction valve 160 may be in an open state, allowing fluid to flow to the suction unit 140. Therefore, fluid sucked by the suction unit 140 from the cold beverage tank 135 cannot enter the cold beverage unit 130 and only flows to the hot beverage unit 120. The cold unit valve 142 and the hot unit valve 145 may be connected to the control unit 177 handling the sanitation cycle. When sanitizing, the control unit 177 may transmit commands to the cold unit valve 142 to be in a closed state and to the hot unit valve 145 to be in an open state. In such case, fluid can flow from the cold beverage unit 130 to the hot beverage unit 120 via the suction unit 140. When a command may be received from the control unit 177, the cold unit valve 142 may be configured to a closed state and the hot unit valve 145 may be configured to an open state, the suction unit 140 sucks fluid from the cold beverage unit 130 and may transfer the sucked fluid to the hot beverage unit 120.

In some embodiments, suction valve 160 and supply valve 182 may be united into a single valve that performs two functions. In one function the single valve may control beverage supply from the beverage supplying unit 620 to the rest of the beverage dispensing apparatus. In the second function it may cause fluid to flow into the suction unit 140 during the sanitation cycles.

When fluid sucked from the cold beverage unit 130 enters the hot beverage unit 120, a portion of the fluid previously contained in the hot beverage tank 125 may be pushed from the hot beverage tank 125 via a pressure relief tank 180 to a pressure relief tube 162. The pressure relief tank 180 regulates fluid flow upwards from the hot beverage tank 125 to the pressure relief tube 162 for sanitation of the tubes, e.g. during the primary sanitation cycle. Fluid then is circulated from the hot beverage tank 125 to the cold beverage tank 135 through the pressure relief tube 162 and then flows to the hot outlet tube 165 and is circulated to the cold outlet tube 155 via the outlet valve 148 and from the cold outlet tube 155 to the first cold suction tube 150. From the first cold suction tube 150, fluid flows back to the hot beverage unit 120 via hot inlet tube 168. Then, fluid flows from the hot inlet tube 168 via the hot beverage tank 125 to the pressure relief tube 162. This way, fluid flows from the hot beverage tank 125 through the tubes of the cold beverage unit 130 and the hot beverage unit 120 and cleans the tubes of the beverage dispensing apparatus 105.

The pressure relief tube 162 may be also connected to a drain tube 172 which leads fluid to a drain 170. A drain valve 144 may be located on the drain tube 172 is configurable, in order to control fluid flow from pressure relief tube 162 to the drain 170. Fluid may be pushed from the hot beverage unit 120 and may be directed to the pressure relief tube 162 instead of the drain tube 172 by the pressure relief tank 180. When there may be an excessive amount of fluid at the pressure relief tank 180, some of the fluid can flow via the drain tube 172 to the drain 170 where fluid may be gathered and later drained. The drain 170 regulates the atmospheric pressure in the tubes of the beverage dispensing apparatus 105.

In some embodiments, at least one cycle of hot fluid flowing through the tubes of the cold beverage unit 130 may be required for sanitizing the hot beverage unit 130. In some embodiments, a plurality of cycles of hot fluid flowing through the tubes of the cold beverage unit 130 may be required. The cold beverage tank 135, hot beverage tank 125 and some of the tubes are cleaned after one cycle of hot fluid. Before circulating fluid in the beverage dispensing apparatus, the condenser that cools fluid at the cold beverage tank 135 may be disabled. Then, the fluid from the hot beverage tank 125 circulates in the pumps of the beverage container apparatus, and fluid from the cold beverage tank 135 may be circulated into the hot beverage tank 125. Such circulation takes place for a period of 1-10 minutes, until the fluid in both the cold beverage tank 135 and the hot beverage tank 125 reaches a predefined temperature, for example 87 degrees Celsius. Then, the fluid may be circulated in a higher speed for another period of time, for example 4 minutes. After a circulation period of about 1-10 minutes, hot fluid flow in the tubes of the beverage dispensing apparatus, and the hot beverage unit 130 may be cleaned. The cold beverage tank 135, hot beverage tank 125 and some of the tubes are cleaned after one circulation period. In some cases, at least a portion of the tubes of the beverage dispensing apparatus are also cleaned. Such tubes may be the hot inlet tube 168, the cold outlet tube 155, the first cold suction tube 150, pressure relief tube 162 and the hot outlet tube 165.

FIG. 3 shows a method and system for a secondary sanitation cycle, according to exemplary embodiments of the disclosed subject matter. In the example disclosed above with relation to FIG. 2, a primary sanitation cycle relates to the process of sucking fluid from one beverage tank and sanitizing components of the beverage dispensing apparatus, such as tubes, valves and the beverage tank from which fluid may be sucked.

In FIG. 3, the secondary sanitation cycle includes sanitizing a different subset of components, which were not cleaned during the primary sanitation cycle, e.g. the second cold suction tube 152. To clean the second cold suction tube 152, the cold unit valve 142 may be in an open state and the hot unit valve 145, the drain valve 144 and the supply valve 182 may be in closed state.

The suction valve 160 may be in an open state, causing fluid to flow into the suction unit 140. The outlet valve 148 remains closed during the sanitation of the second cold suction tube 152. When sanitizing the second cold suction tube 152, fluid flows from the suction unit 140 via the cold unit valve 142 to the second cold suction tube 152.

Altering between a secondary sanitation cycle which may include the second cold suction tube 152 and a primary sanitation cycle which may include the rest of the tubes may be determined by the control unit 177. The control unit 177 may be connected to the valves and the suction unit 140. The control unit 177 determines the appropriate configuration of the valves in each sanitation cycle, e.g. which valves are configured to be in a closed state and which valves are configured to be in an open state. The control unit 177 may determine the time allocated for a primary and/or secondary sanitation cycle, e.g. the time duration of the sanitation cycle that includes cold beverage unit 130 and the time duration required for a sanitation cycle of the second cold suction tube 152.

In some exemplary cases, the first cold suction tube 150 added to the beverage dispensing unit 105 may be connected to the hot beverage unit 120, not to the cold beverage unit 130 as disclosed in the exemplary embodiment above. The first cold suction tube 150 may be removable. In some cases, the beverage dispensing apparatus 105 may comprise connectors at both the hot beverage unit 120 and the cold beverage unit 130, for enabling connection of the first cold suction tube 150 as an add-on and not as an integral part of the beverage dispensing apparatus 105.

Figure 4:
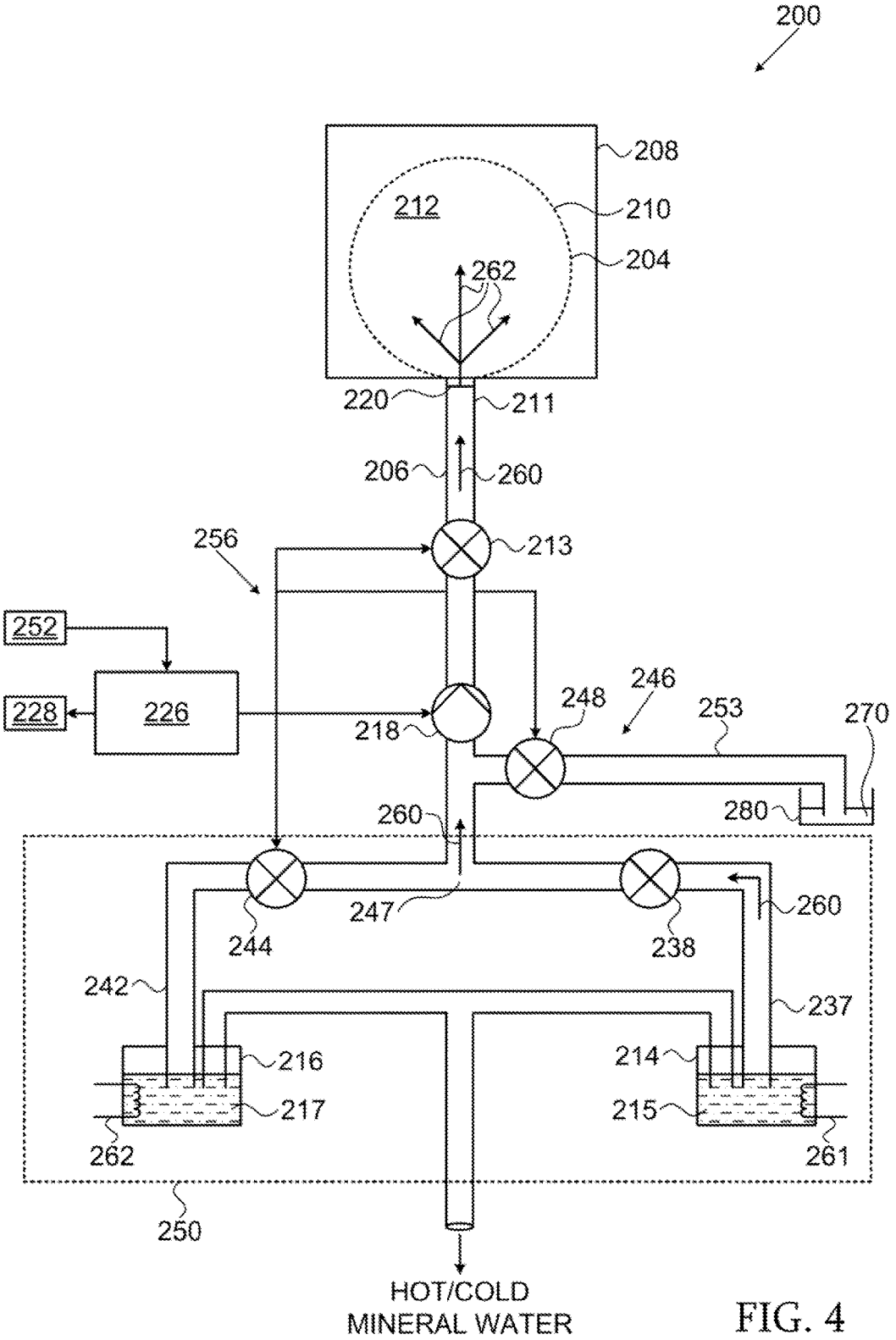
FIG. 4 schematically presents the hot/cold beverage dispenser in an arrangement for cleansing a beverage container and an associated beverage flow system, in accordance with an embodiment of the present invention.

Reference is now made to FIG. 4, which schematically presents the hot/cold beverage dispenser 200 in an arrangement for cleansing a beverage flow system 206 and a beverage connector 220. The hot/cold beverage dispenser 200 provides hot and/or cold beverage to a user by means of the beverage dispensing system 250, shown schematically in FIGS. 4 and 5 and as known in the art. The beverage dispensing system 250 may include, inter alia, a hot beverage tank 214 containing hot beverage 215 maintained at a temperature of above 90° C. by means of a beverage heater 261 and a cold beverage tank 216 containing cold beverage 217 maintained at a temperature of about 4-15° C. by means of a beverage cooler 262, as known in the art. Selectively, beverage 212, contained in the beverage container 204, may be supplied to the hot beverage tank 214 via a hot beverage valve 238 and a hot beverage conduit 237 and may be supplied to the cold beverage tank 216 via a cold beverage valve 244 and a cold beverage conduit 242. The user may operate the dispenser 200 by activating hot/cold beverage faucets (not shown), as known in the art, thereby selectively obtaining hot beverage 215 and cold beverage 217 from the hot/cold beverage dispenser 200.

The hot/cold beverage dispenser 200 may further include, inter alia, a housing 208 enclosing the beverage container 204, such as a Bag-in-a-Box storage (BIB) 210 containing the beverage 212.

The beverage flow system 206 may include, inter alia, a beverage conduit 211 and a beverage connector 220. The beverage conduit 211 may be fluidly coupled the beverage connector 220 to a sanitation valve 213. The BIB 210 may be mechanically and fluidly coupled to the beverage connector 220 by the user of the beverage dispenser 200. Typically, the user may manually couple an outlet of the BIB 210 to the beverage connector 220. The BIB 210 may be in beverage communications with the beverage system 206 by means of the beverage connector 220.

A beverage pump 218, such as reversible direction pump, may be coupled between the beverage flow system 206 and the beverage dispensing system 250, as shown in FIG. 4. The beverage pump 218 may be operationally configured to pump beverage in a forward pumping direction and in a reverse pumping direction. In the forward pumping direction, the beverage pump 218 may pump beverage in the forward flow direction from the BIB 210 to the beverage dispensing system 250 via the beverage flow system 206. In the reverse pumping direction, the beverage pump 218 may pump fluid in the reverse flow direction from the beverage dispensing system 250 to the BIB 210 via the beverage flow system 206.

The beverage flow system 206 may be fluidly coupled to the beverage pump 218 via the sanitation valve 213 and the beverage pump 218 may be fluidly coupled to the beverage dispensing system 250 via a three-way beverage junction 247. The three-way beverage junction 247 may fluidly couple the hot beverage tank 214 via the hot beverage conduit 237 and a hot flow valve 238 to the beverage pump 218. The three-way beverage junction 247 also may fluidly couple the cold beverage tank 216 to the beverage pump 218 via the cold beverage conduit 242 and a cold flow valve 244.

A control unit 226 controls the cleansing operation and may be in communications with at least the beverage pump 218, the sanitation valve 213, the hot beverage valve 238 and the cold beverage valve 244, as shown in FIG. 4, via a communications bus 256. A display 228 may be electrically coupled to the control unit 226 and may display the operational status of the cleansing operation to a user and a control panel 252 may be also electrically coupled to the control unit 226 enabling the user to control the cleansing operation as well as supplying data and information to the control unit 226, as described below.

In accordance with another embodiment of the present invention, the hot/cold beverage dispenser 200 may include a beverage drainage system 246 which may be fluidly coupled to the junction 247, as shown in FIG. 4. The beverage drainage system 246 may include, inter alia, a drain valve 248, a drain beverage conduit 253 and a beverage drain 280. The beverage drainage system 246 provides a drainage system typically for draining residual beverage 270 (FIG. 5) remaining in the dispenser 200 following a cleansing operation. The opening and closing of the drain valve 248 may be controlled by the control unit 226 via the communications bus 256.

Following the emptying of the BIB 210, the user inserts a replacement BIB into the housing 208. The user inserts the replacement BIB in the housing 208 and couples the BIB 210 to the beverage connector 220, as described above. The replacement BIB may be now in an operational status for resupplying the beverage 212 to the beverage dispensing system 250.

In order to maintain the hot/cold beverage dispenser 200 in a hygienic status, the cleansing operation may be performed prior to replacing the empty BIB 210 with a replacement BIB unit. During the cleansing operation, hot fluid may be pumped from the hot beverage tank 214 to the BIB 210 via the beverage flow system 206, may be spraying hot fluid into the BIB 210, as described below.

The control unit 226 may monitor and record the number of replacement BIB units inserted into the hot/cold beverage dispenser 200 and following the replacement of a predetermined number of BIB units, typically ten BIB units, the control unit 226 may initiate a cleansing operation of a current empty BIB unit 210 and the beverage conduit 204. It is appreciated that the user may alter the number of replacement BB units by inputting the required information into the control unit 226 by means of the control panel 252.

When the desired number of BIB units has been replaced, the control unit 226 may display a notification, such as "INITIATE A CLEANSING OPERATION", on the display 228. Thus, the user may be informed that the cleansing operation is being initiated. If the user does not wish to proceed with the cleansing operation, the user may activate an appropriate control on the control panel 252 of the control unit 226 and the cleansing operation terminates. A notification, such as "CLEANSING OPERATION USER TERMINATED", may appear on the display 228.

If the user wishes to proceed with the cleansing operation, the user may activate the appropriate activation control on the control panel 252 and the cleansing operation may proceed. The control unit 226 may check the temperature of the hot beverage 215 contained in the hot beverage tank 214. If the hot beverage 215 may be at a required temperature for the cleansing operation, typically at approximately 90° C., a notification, such as "CLEANSING OPERATION INITIATED", may appear on the display 228.

If the hot fluid temperature is less than the required temperature, the control unit 226 may forward a heat-fluid instruction to the beverage heater 261 to commence a heating operation to heat the fluid in the hot beverage tank 214 to the required temperature. A notification, such as "BEVERAGE HEATING OPERATION IN PROGRESS", may appear on the display 228. On reaching the required hot fluid temperature, a notification, such as "FLUID HEATED TO REQUIRED TEMPERATURE", may appear on the display 228.

Upon completion of heating of the fluid in the hot beverage tank 214, alternatively, if the hot fluid in the hot beverage tank 214 may be at the required temperature, the cleansing operation commences and a notification, such as "CLEANSING OPERATION COMMENCING", may appear on the display 228. The control unit 226 may configure the beverage pump 218 to reverse the pumping direction of the pump 218 to the reverse pumping direction.

Concomitantly with configuring the beverage pump 218 to reverse the pumping direction, the control unit 226 may configure the cold beverage valve 244 to a closed state, and the hot beverage valve 238 and the sanitation valve 213 to an open state. On receiving confirmation that the cold beverage valve 244 has closed and the hot beverage valve 238 and the sanitation valve 213 have opened, the control unit 226 may configure the beverage pump 218 to commence pumping a quantity of hot fluid from the hot beverage tank 214 to the beverage system 206 and the BIB 210. The quantity of hot fluid pumped from the hot beverage tank 125 when sanitizing the beverage flow system 206 may be in a range of, for example, 5-50 ml. A notification, such as "CLEANSING OPERATION IN PROGRESS", may be displayed visually and/or audibly, e.g. on the display 228.

The beverage pump 218 may commence pumping the quantity of hot fluid from the hot beverage tank 214 to the BIB 210 via the beverage flow system 206, as indicated by a flow arrow 260. The quantity of hot beverage 231 reaches the beverage connector 220 and may be sprayed into the BIB 210 as indicated by spray arrows 262. Thus, the flow conduit 211 are cleansed with hot fluid. The pumping operation may continue for a first predetermined time period, typically for a period of three seconds.

At the termination of the first predetermined time period which is the duration of the primary sanitation cycle, the control unit 226 may configure the beverage pump 218 to cease pumping. The quantity of hot fluid may be retained in the beverage conduit 211, the beverage connector 220 and the BIB 210 for a predetermined cleansing time period, typically for a time period of three minutes, typically at a temperature of approximately 90° C. In alternative embodiments, prior to the user replacing the BIB 210, the residual hot beverage 270 may be drained from the dispenser 200, as described below.

At the termination of the cleansing time period, a notification, such as "CLEANSING OPERATION COMPLETED", may appear on the display 228.

Figure 5:
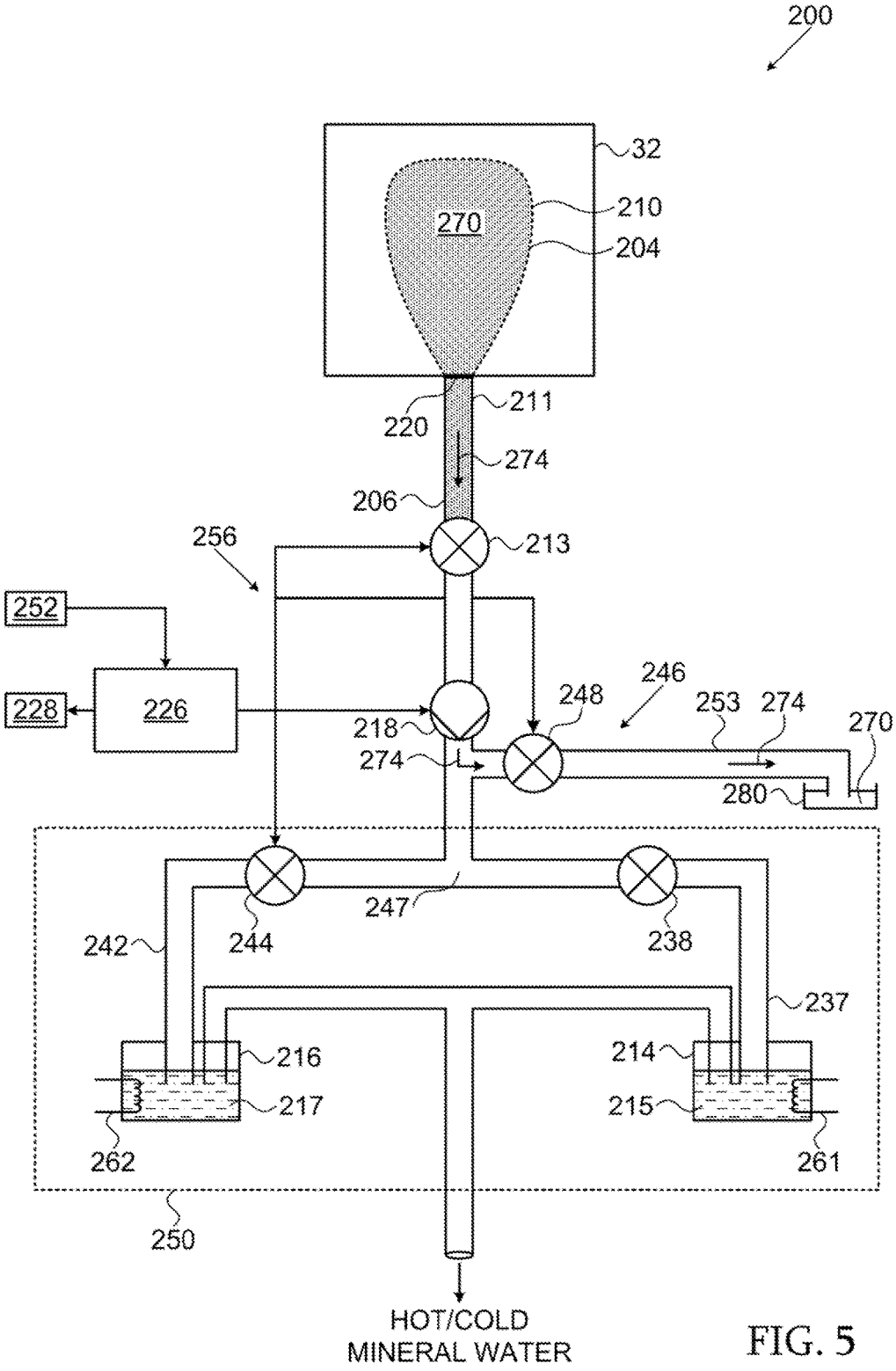
FIG. 5 schematically presents the hot/cold dispenser in an arrangement for draining the residual hot beverage from the hot/cold beverage dispenser, in accordance with an embodiment of the present invention.

Reference is now made to FIG. 5, which schematically presents the hot/cold beverage dispenser 200 in an arrangement for draining the residual hot beverage 270 from the hot/cold beverage dispenser 200, in accordance with an embodiment of the present invention. Subsequent to completion of the cleansing operation of the BIB unit 210 and the flow beverage system 206, the control unit 226 generates an instruction to the pump 218 to change the pumping direction from the reverse direction to the forward direction.

In accordance with another embodiment of the present invention, concomitantly with generating the instruction to change the pumping direction, the control unit 226 may configure the hot beverage valve 238 to a closed state and may configure the drainage pump 248 to an open state. The cold beverage valve 244 remains in a closed state and the sanitation valve 213 remains in an open state. Thus, a fluid flow pathway may be established from the BIB 210 to the beverage drainage system 246 via the beverage system 206 and the beverage connector 220, as indicated by the flow arrow 274.

On receiving confirmation that the hot beverage valve 238 may be closed and that the drainage pump 248 may be opened, the control unit 226 may configure the beverage pump 218 to commence pumping for a predetermined period of 1-10 seconds and the residual beverage 270 may be pumped from the BIB 210, the beverage connector 220 and the beverage system 206 to the beverage drainage system 246 as indicated by a beverage flow arrow 274.

Thus, the residual hot beverage 270 may be drained from the BIB 212 and the beverage flow system 206 to a beverage drain 280 via the drainage flow system 246, or back to the hot beverage tank 214.

Subsequent to draining the residual hot beverage 270 from the dispenser 200, the user may be able to replace the empty BIB unit with a replacement full BIB 210 and may reuse the hot/cold beverage dispenser 200 following the cleansing operation.

It is appreciated that the user has an option to operate the hot/cold beverage dispenser 200 in an energy-saving mode. In the energy-saving mode, the temperature of the hot beverage 215 may be typically maintained at a temperature of approximately 60° C. Alternatively, the user may not wish to heat the beverage in the hot beverage tank 214 and the beverage therein may be typically at room temperature.

Additionally or alternatively, as described above, the user has an option not perform the cleansing operation.

However, in order to maintain the hygiene of the dispenser 200, subsequent to the replacement of typically 10 BIB units, the control unit 226 checks the temperature of the hot beverage 215 each time the user replaces a BIB unit. If a cleansing operation may be not initiated after the replacement of, typically, 10 BIB units, the control unit 226 may continue to check the temperature of the hot beverage 215 each time a BIB unit may be replaced. When the user selects to operate the dispenser 200 on an energy saving mode or to disable the heating unit, the control unit 226 may provide the user with a message recommending performing the sanitation process disclosed above. The control unit 226 may sample the temperature of the hot beverage tank 125 every predefined number of BIB units, to suggest the user to perform the sanitation process in case the temperature of the hot beverage tank 125 may be back to normal, for example above 85° Celsius degrees.

Figure 6:
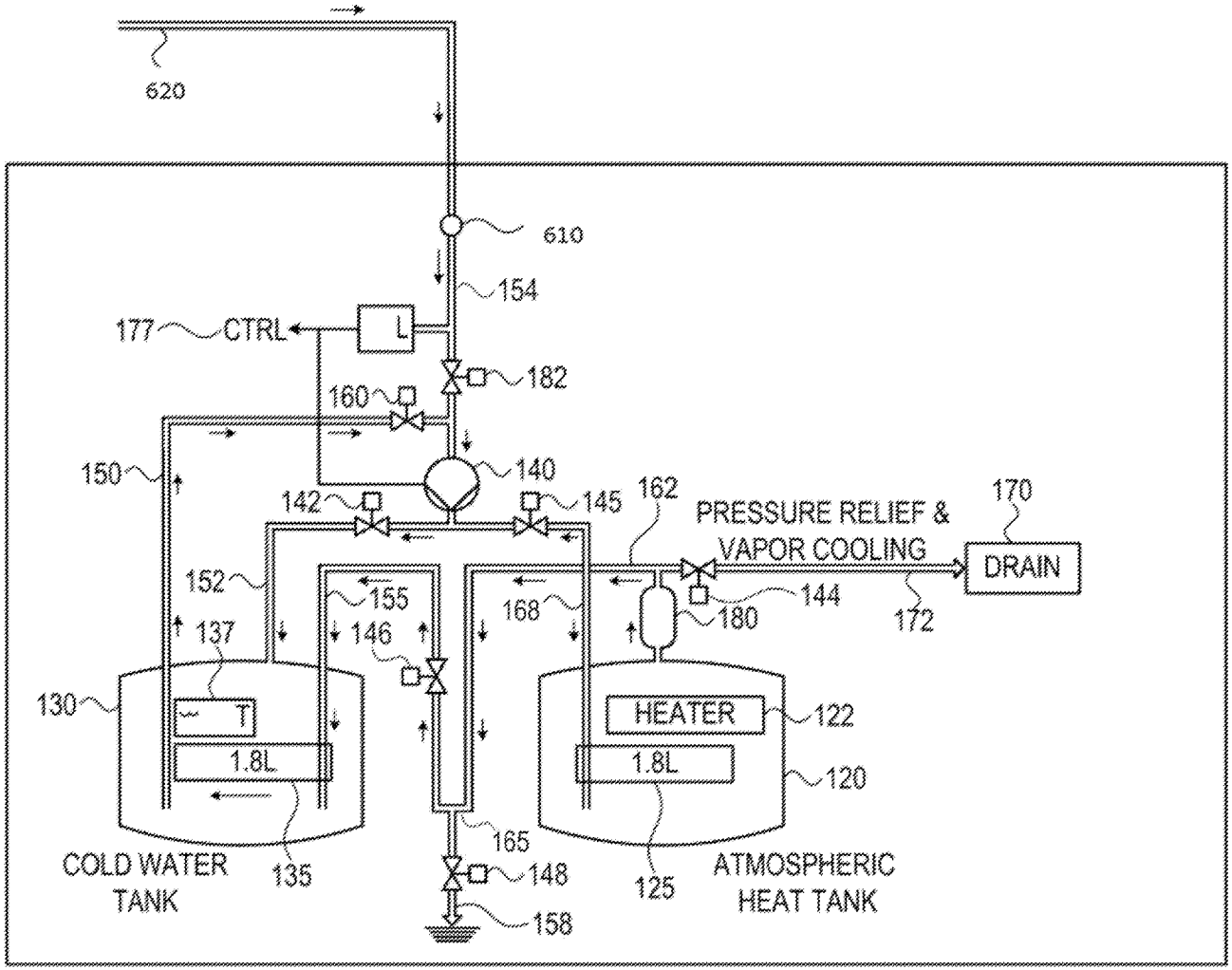
FIG. 6 is a schematic illustration of a beverage dispensing apparatus connected to a beverage dispensing system (which is described in FIG. 5) and comprising a sanitation system, according to embodiments of the subject matter.

FIG. 6 is a schematic illustration of a beverage dispensing apparatus. The beverage dispensing apparatus may include a sanitation system, according to some exemplary embodiments of the subject matter. The beverage dispensing apparatus 600 comprises an inlet 610 connecting a beverage supplying unit 620 to the apparatus.

The beverage supplying unit 620 may be a mineral water container (e.g. a BIB), a beverage container, or may be water (e.g. filtered water) received from a water supply system of e.g. an office, a factory or a private home, etc. The beverage supplying unit 620 may be connected to a central beverage system from which beverage may be provided to the beverage dispensing apparatus 600. The beverage may be filtered or purified in the beverage dispensing apparatus 600. In such a case, the beverage dispensing apparatus 600 may comprise one or more filters to filter the beverage received from the beverage supplying unit 620. The characteristics of the filters, such as size, type and mechanisms may be selected by a person skilled in the art.

In some embodiments, the sanitation cycles may be performed using water, e.g. filtered water or mineral water if the beverage dispensing apparatus is a water dispenser, and/or other types of beverages (e.g. coffee machines, soft drinks dispensers, etc.).

Beverage flows from the beverage supplying unit 620 via the inlet 610 and the supplying tube 154 to the tubes of the beverage dispensing apparatus 600 and to the suction unit 140, which may be a reversible direction suction unit or pump. In an embodiment of the present invention, the beverage supplying unit 620 may be connected directly to suction unit 140. The cold tank outlet valve 146 may be positioned in the cold outlet tube 155.

The drain valve 144 may be located in the drain tube 172 and may be configured to a closed state during at least a portion of a primary and/or a secondary sanitation cycle, to control fluid dispensed from the drain 170. For example, the drain valve 144 may be configured to a closed state during one phase of a primary sanitation cycle, e.g. while hot water is being circulated in the tubes and valves of the beverage dispensing apparatus, and may be configured to an open state upon completion of a primary and/or secondary sanitation cycle.

Figure 7:
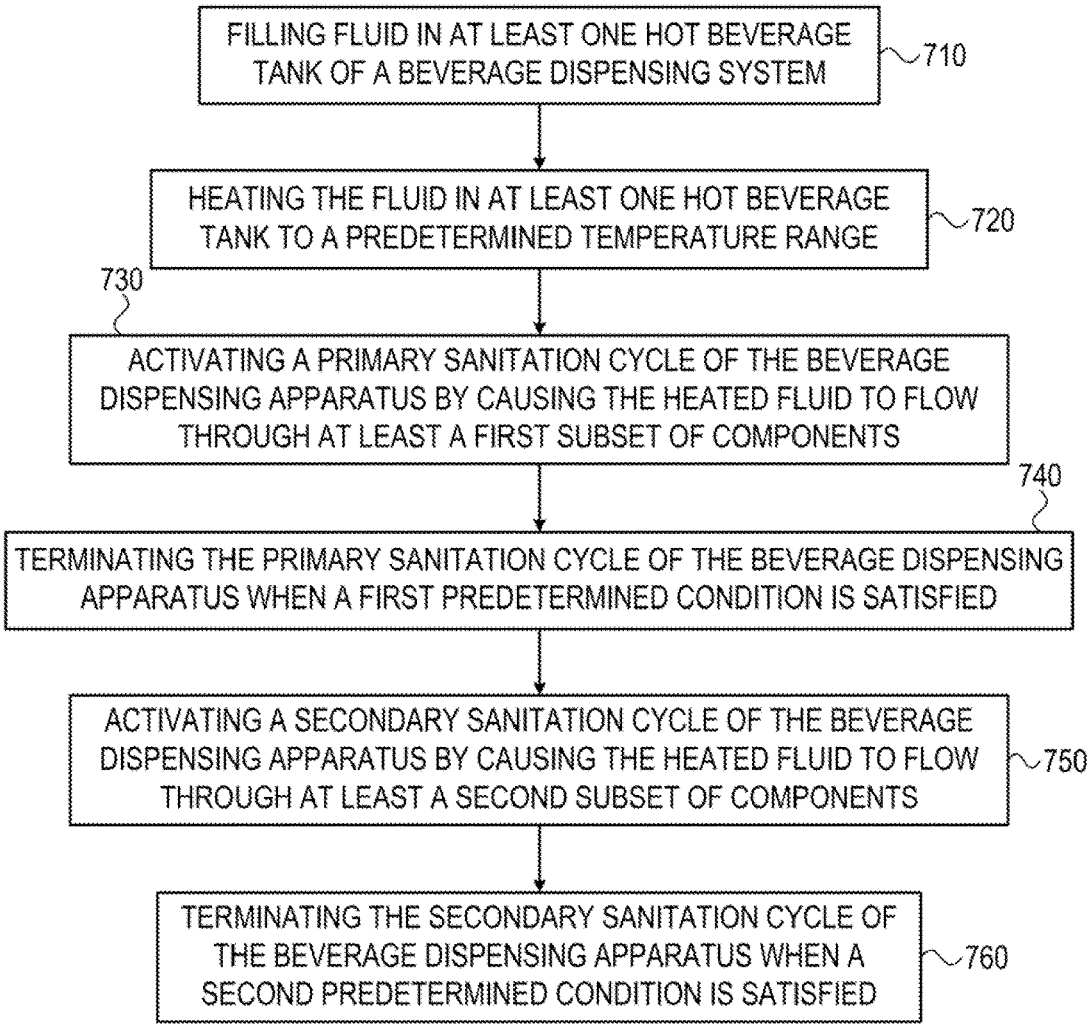
FIG. 7 is a flow chart of a method for sanitizing a beverage dispensing system, according to embodiments of the subject matter.

Reference is now made to FIG. 7, which is a flow chart of a method for sanitizing a beverage dispensing apparatus according to embodiments of the present invention.

In operation 710, a fluid such as water, cleaning fluid, a beverage or any other liquid may be filled in at least one beverage tank of beverage dispensing apparatus. The beverage tank may be filled completely or partially, for example a predetermined portion of the beverage tank may be filled with fluid. Other tanks of the beverage dispensing apparatus may also be filled, either completely or partially. For example, the cold beverage tank 135 may be filled with fluid. Additionally or instead, certain components of the beverage dispensing apparatus may be emptied (partially or completely) from a beverage which may be currently stored therein. For example, the beverage may be sucked from the cold beverage tank 135 and may flow towards the pressure relief drain 170.

In operation 720, the fluid in at least one hot beverage tank, e.g. the hot beverage tank 125, may be heated to a predetermined temperature. For example, the fluid may be heated until it reaches a predetermined sanitation temperature range, e.g. 87°-90° Celsius. Other ranges of temperature may be used.

In operation 730, one or more sanitation cycles may be activated. A primary sanitation cycle may include controlling (e.g. using control unit 177) the beverage dispensing apparatus to cause the heated fluid in the hot beverage tank 125 to start flowing through at least a portion or a subset of components such as tubes, valves, tanks, suction unit, and/or other components of the beverage dispensing apparatus, for example components through which fluid may be transferred during a beverage dispensing operation of the beverage dispensing apparatus.

Referring to FIG. 2, the primary sanitation cycle may include the process of fluid sucked by the suction unit 140 from the cold beverage tank 135 flowing to the hot beverage tank 125, through the hot outlet tube 165 and through the cold outlet tube 155. The primary sanitation cycle may also include activating the suction unit 140 to cause hot fluid from the hot beverage tank 125 to flow through the tubes of the cold unit 130 and the hot unit 120 and to sanitize at least a portion of the tubes of the beverage dispensing apparatus 105.

A sanitation cycle may include at least one predetermined time duration during which hot fluid flows through the subset of components of the beverage dispensing apparatus, e.g. a sanitation cycle of the cold beverage unit 130 may include at least one predetermined time period during which hot fluid flows through the tubes of the cold beverage unit 130 (e.g. 4 minutes or 10 minutes).

In operations 740, one or more conditions may be checked, e.g. by the control unit 177, in order to determine when to terminate or stop the primary sanitation cycle. In some embodiments, a condition for stopping a sanitation cycle may be time-based. A predetermined time duration may be set for each sanitation cycle, for example 4 minutes, 8 minutes or 15 minutes. When the predetermined time duration has lapsed, e.g. a duration of 4 minutes has passed since activating the sanitation cycle, the sanitation cycle may be stopped by the control unit 177.

In another example, a condition for stopping the sanitation cycle may be temperature-based. A predetermined temperature (or temperature range) of the fluid in at least one component of the beverage dispensing apparatus may be checked to determine whether to stop a sanitation cycle. For example, the temperature of the fluid in one beverage tank (and/or in one or more additional components of the beverage dispensing apparatus) may be monitored. In some embodiments, if the fluid in a beverage tank (and/or in tubes and/or in valves and/or in other components of the beverage dispensing apparatus) reaches a first temperature threshold of at least, e.g., 90 degrees Celsius, the heating unit may be switched off, and the fluid may be caused to flow through at least a subset of components of the beverage dispensing apparatus. When the fluid reaches a second temperature threshold, e.g. 85 degrees Celsius, the sanitation cycle may be stopped by the control unit 177. Other types of conditions may be used, and other thresholds may be set.

In operation 750, a secondary sanitation cycle may be activated, e.g. by control unit 177. The secondary sanitation cycle may include sanitizing a second subset of components of the beverage dispensing apparatus, which may be different from the subset of components which were cleaned or sanitized in the primary sanitation cycle. For example, a secondary sanitation cycle may include sanitizing the second cold suction tube 152, such that hot fluid flows into the suction unit 140, and from the suction unit 140 via the cold unit valve 142 to the second cold suction tube 152. A predetermined time duration may be allocated for each sanitation cycle.

During each sanitation cycle, the suction unit 140 may be continuously, periodically, or alternatingly activated, in order to cause the hot fluid to flow through the subset of components that is being cleaned during each sanitation cycle. It is noted that in some embodiments, the fluid need not be hot fluid, and may contain sanitizing substance instead.

The temperature of the hot fluid flowing through the beverage dispensing apparatus may be maintained throughout the primary and/or the secondary sanitation cycles, e.g. to be within a predetermined temperature range which is sufficient for sanitation.

In operation 760, one or more conditions may be checked, e.g. by the control unit 177, in order to determine when to terminate or stop the secondary sanitation cycle. In some embodiments, a condition for stopping a sanitation cycle may be time-based. A predetermined time duration may be set for each sanitation cycle, for example 4 minutes, 10 minutes or 14 minutes. When the predetermined time duration may be completed, e.g. a duration of 4 minutes has passed since activating the sanitation cycle, the sanitation cycle may be stopped by the control unit 177.

In some embodiments, the primary and/or secondary sanitation cycles may be performed using a using a cold fluid instead of the hot fluid. For example, a sanitizing fluid or substance such as a chlorine solution or a citric acid solution may be used to sanitize components of the beverage dispenser apparatus. The solution may be caused to flow through at least a subset of components of the beverage dispenser apparatus, until a predetermined condition may be satisfied and the sanitation cycle may be terminated. In another example, a combination of hot fluid and a sanitation solution may be used in the sanitation cycles.

According to some embodiments, a sanitation process may include a plurality of sanitation cycles, and each sanitation cycle may be activated more than once in order to complete a sanitation process of a beverage dispensing apparatus. For example, a primary sanitation cycle which causes hot fluid to flow through a first subset of components of the beverage dispensing apparatus may be activated, e.g. for at least a predetermined time duration of 4 minutes. According to some embodiments, a secondary sanitation cycle includes configuring the suction unit 140 to cause hot fluid to flow through a second subset of components of the beverage dispensing apparatus, e.g. for at least another predetermined duration of time. In some embodiments, the duration of each cycle may be controllable and may be changed. A plurality of sanitation cycles may be activated in order to complete a full sanitation process of a beverage dispensing apparatus. For example, each of the primary sanitation cycle and the secondary sanitation cycle may be activated twice during a single sanitation process, in order to ensure sanitation of the beverage dispensing apparatus.

In some embodiments, a sanitation process or sanitation cycle of one or more components of a beverage dispensing apparatus may be scheduled to be performed, for example automatically, every preset time period. In addition or instead, a user may request activation of one or more sanitation cycles and/or sanitation phases. In yet other embodiments, one or more sanitation process or cycle may be activated based on a predetermined amount of beverage that was dispensed since a previous sanitation cycle was activated.

Optionally, the beverage dispensing apparatus may display a notification to a user that activation of a sanitation process and/or a sanitation cycle may be required, and/or that a sanitation cycle or process has been completed, and/or that a sanitation cycle or process may be currently being performed.

In some embodiments, the beverage dispenser apparatus disables or blocks dispensing of a cold beverage, e.g. by configuring cold unit valve 142 and/or the cold tank outlet valve 146 to a closed position, e.g. during and immediately after one or more sanitation cycles are completed. During the sanitation cycles, the fluid in the cold tank and in the hot tank may reach a hot temperature, thus the fluid must be cooled before a cold beverage may be dispensed.

Figure 8:
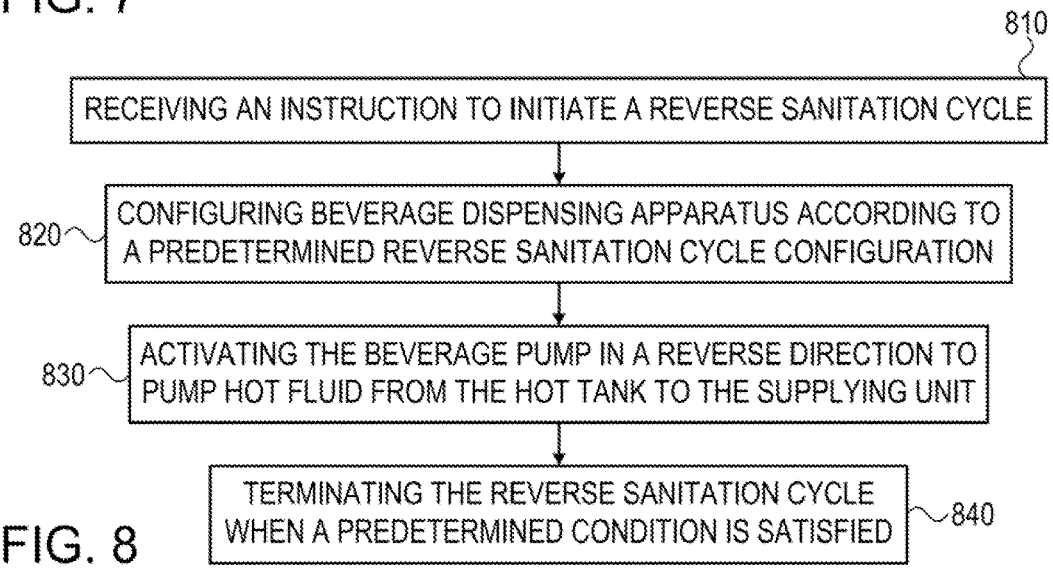
FIG. 8 is a flow chart of a method for reverse sanitizing the beverage dispensing system, according to some exemplary embodiments of the subject matter.

Reference is now made to FIG. 8, which is a flow chart of a method for a reverse sanitizing of a beverage dispensing apparatus according to embodiments of the present invention. In some embodiments the user receives a visual or audible notification or indication informing that a reverse sanitizing of the beverage dispensing apparatus may begin, for example a visual notification such as "REVERSE CLEANSING OPERATION COMMENCING" may appear on a display unit.

In operation 810, an instruction to initiate a reverse sanitizing cycle may be sent by the control unit 177. The control unit 177 may be configured and may activate the suction unit 140 to pump fluid in a reverse pumping direction in order to enable fluid to flow from the hot beverage tank 125 towards beverage supplying unit 620.

In operation 820, the beverage dispensing apparatus may be configured to activate the reverse sanitation cycle. Concomitantly with configuring the suction unit 140 to reverse the pumping direction (operation 830), the control unit 177 may configure the cold unit valve 142 and the drain valve 144 to be in a close state and the hot unit valve 145 and the supply valve 182 to be in an open state. On receiving confirmation that the cold unit valve 142 and drain valve 144 may be in a closed state and the hot unit valve 145 and the supply valve 182 may be an open state, the control unit 177 may configure the suction unit 140 to commence pumping a quantity of hot fluid from the hot beverage tank 125 to the towards the beverage supplying unit 620. The quantity of hot fluid pumped from the hot beverage tank 125 when the reverse cycle may be activated may be in a range of, for example, 5-50 ml. A notification, such as "REVERSE CLEANSING OPERATION IN PROGRESS" may appear on a display unit.

The suction unit 140 may commence pumping the quantity of hot fluid from the hot beverage tank 125 to the beverage supplying unit 620 via the inlet 610. A quantity of hot fluid may reach the inlet 610 and thus a supplying tube 154, which may connect the suction unit 140 and inlet 610, may be sanitized with hot fluid. The pumping operation may continue until a predetermined condition is satisfied, for example: till a first predetermined time period has lapsed (e.g. for a period of three seconds, 1 minute, or 5 minutes).

In operation 840, termination of the reverse sanitation cycle may be performed upon determination that a predetermined condition is satisfied. For example, after the first predetermined time duration has lapsed, the control unit 177 may configure the suction unit 140 to cease pumping. The quantity of hot fluid may be retained in the supplying tube 154 for a predetermined cleansing time duration, e.g. for a time period of three minutes, at a predetermined temperature or temperature range (e.g. a temperature range of 88-95° C., or at approximately 90° C.).

Upon termination of the sanitation cycle, a notification, such as "REVERSE CLEANSING OPERATION COMPLETED", may be visually displayed to a user, e.g. may appear on a display unit of the beverage dispenser apparatus.

In some embodiments, the beverage dispenser apparatus disables or blocks dispensing of a cold beverage, e.g. by configuring cold unit valve 142 and/or the cold tank outlet valve 146 to a closed state, e.g. during and immediately after one or more sanitation cycles are completed. During the sanitation cycles, the fluid in the cold tank and in the hot tank may reach a hot temperature, thus it is desirable that the fluid is cooled before a cold beverage is dispensed.

A predetermined condition may be checked before the beverage dispenser enables dispensing of cold beverage. For example, a minimal waiting time duration may be set, during which only hot beverage may be dispensed from the beverage dispenser, e.g. a few minutes or another predetermined time duration. In some embodiments, the predetermined condition may be checking if the beverage in the cold tank 135 reaches a certain cold threshold temperature, such as below 35° C., or in a range of 5-15° Celsius.

A pre-cooling cycle may include flow of cold beverage from the cold beverage tank 135 via the cold outlet tube 155 in order to ensure that hot fluid does not remain in cold outlet tube 155, and thus ensuring the beverage dispensed via the cold outlet tube 155 is sufficiently Cold.

The pre-cooling cycle may be activated when an instruction to dispense cold beverage may be received from a user, in order to ensure that the beverage dispensed from the beverage dispenser apparatus may be sufficiently cold.

In order to initiate the pre-cooling cycle, a predetermined condition may be checked, for example checking whether a minimal time duration has lapsed since a cold beverage was last dispensed from the beverage dispensing apparatus, or if at least a certain time period has lapsed since dispensing a hot beverage. For example, if in the last few minutes, e.g. 10 minutes, cold beverage was not dispensed from the beverage dispensing apparatus, or if hot beverage was dispensed recently from the beverage dispensing apparatus (e.g. within the range of 30 minutes), the pre-cooling cycle may be activated.

The pre-cooling cycle may last only a short time period, e.g. a few seconds. When the pre-cooling cycle may be activated, the cold unit valve 142 and/or the drain valve 144, and/or the outlet valve 148 may be configured to a closed state, and the hot unit valve 145 and/or the cold tank outlet 146 may be configured to an open state.

While the disclosure has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings without departing from the essential scope thereof. Therefore, it is intended that the disclosed subject matter not be limited to the particular embodiment disclosed as the best mode contemplated for carrying out this invention, but only by the claims that follow.

The invention claimed is:

1. A method for sanitizing a beverage dispenser apparatus, comprising:

a reversible pump pumping fluid from a beverage supplying unit into at least a hot beverage tank of a beverage dispensing apparatus;

a heating unit heating the fluid in the hot beverage tank to a predetermined temperature range;

a control unit configuring a supply valve and a suction valve to a closed or a opened state respectively to configure the beverage dispenser apparatus to begin a sanitation event which includes a primary sanitation cycle and a secondary sanitation cycle, wherein the secondary sanitation cycle includes sanitizing a different subset of components than sanitized in the primary sanitation cycle;

the control unit activating the primary sanitation cycle by causing the reversible pump to pump the heated fluid, from the hot beverage tank to flow through at least a first subset of components of the beverage dispenser apparatus;

the control unit terminating the primary sanitation cycle when at least one predetermined condition is satisfied;

the control unit activating the secondary sanitation cycle by causing the reversible pump to pump the heated fluid from the hot beverage tank to flow through at least a second subset of components of the beverage dispenser apparatus;

wherein the supply valve, which is located between the beverage supplying unit and the hot beverage tank is in a closed state to prevent fluid from entering into the beverage supplying unit; and the control unit terminating the secondary sanitation cycle when at least a second predetermined condition is satisfied.

2. The method of claim 1, further comprising during the primary sanitation cycle the control unit configures a hot unit valve and the suction valve to an open state and a cold unit valve to a closed state; and during the secondary sanitation cycle the control unit configures the cold unit valve and the suction valve to an open state and the hot unit valve to a closed state.

3. The method of claim 1 wherein the predetermined condition includes the control unit checking whether a predetermined time duration has lapsed.

4. The method of claim 1 wherein the control unit activating the primary sanitation cycle comprises causing the reversible pump to pump fluid to flow from a hot beverage tank to a cold beverage tank.

5. The method of claim 1 comprising the beverage dispenser apparatus notifying a user regarding the sanitation event.

6. The method of claim 1, further comprising the heating unit heating the fluid until it reaches a first predefined temperature and then the control unit monitoring for the temperature of the heated fluid in order to terminate the sanitation event if the monitored temperature is below a second predetermined temperature value.

7. The method of claim 1, further comprising the control unit configuring a time duration for the primary sanitation cycle and the secondary sanitation cycle.

* * * * *